US007434921B2

(12) United States Patent
Udagawa

(10) Patent No.: US 7,434,921 B2
(45) Date of Patent: Oct. 14, 2008

(54) LIQUID CONTAINER, INK JET RECORDING APPARATUS AND LIQUID FILLING METHOD

(75) Inventor: Kenta Udagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 11/297,416

(22) Filed: Dec. 9, 2005

(65) Prior Publication Data

US 2006/0139418 A1 Jun. 29, 2006

(30) Foreign Application Priority Data

Dec. 9, 2004 (JP) ..... 2004-357303

(51) Int. Cl.
*B41J 2/175* (2006.01)

(52) U.S. Cl. ..... 347/85; 347/87

(58) Field of Classification Search ..... 347/84, 347/85, 86, 87

See application file for complete search history.

(56) References Cited

U.S. PATENT DOCUMENTS

| | | | | |
|---|---|---|---|---|
| 6,145,972 | A | 11/2000 | Udagawa et al. | 347/86 |
| 6,244,695 | B1 | 6/2001 | Udagawa | 347/86 |
| 6,382,786 | B2 | 5/2002 | Iwanaga et al. | 347/86 |
| 6,416,173 | B2 | 7/2002 | Kishida et al. | 347/86 |
| 6,419,349 | B1 | 7/2002 | Iwanaga et al. | 347/86 |
| 6,447,084 | B1 * | 9/2002 | Uetsuki et al. | 347/7 |
| 6,527,381 | B1 | 3/2003 | Udagawa et al. | 347/86 |
| 6,637,872 | B2 | 10/2003 | Ara et al. | 347/85 |
| 6,652,949 | B2 | 11/2003 | Iwanaga et al. | 428/65.9 |
| 6,702,433 | B2 | 3/2004 | Kono | 347/85 |
| 6,742,881 | B2 | 6/2004 | Kotaki et al. | 347/86 |
| 6,799,843 | B2 * | 10/2004 | Okamoto | 347/86 |
| 6,929,341 | B2 * | 8/2005 | Mizoguchi et al. | 347/7 |
| 6,966,637 | B2 * | 11/2005 | Ishizaki | 347/85 |

FOREIGN PATENT DOCUMENTS

| | | |
|---|---|---|
| JP | 8-300677 | 11/1996 |
| JP | 10-128992 | 5/1998 |
| JP | 10-157155 | 6/1998 |
| JP | 2001-301194 | 10/2001 |
| JP | 2001-310477 | 11/2001 |
| JP | 2002-86754 | 3/2002 |
| JP | 2002-234180 | 8/2002 |

* cited by examiner

*Primary Examiner*—Anh T. N. Vo
(74) *Attorney, Agent, or Firm*—Fitzpatrick, Cella, Harper & Scinto

(57) ABSTRACT

A liquid container includes a liquid containing portion for containing ink; a liquid introduction portion for introducing the ink into the liquid containing portion; a liquid discharge portion for discharging the ink to an outside from an inside of the liquid containing portion; a gas-liquid separation film; a gas-liquid blocking portion disposed adjacent to the gas-liquid separation film; wherein the gas-liquid separation film and the gas-liquid blocking portion are constructed such that when the ink is introduced into the liquid containing portion by discharging gas in the liquid containing portion through the gas-liquid separation film, a contact line where a gas-liquid interface between the ink and the gas contacts the gas-liquid separation film moves toward a boundary between the gas-liquid separation film and the gas-liquid blocking portion.

4 Claims, 12 Drawing Sheets

(a)

(b)

LIQUID CONTAINER, INK JET RECORDING APPARATUS AND LIQUID FILLING METHOD

FIELD OF THE INVENTION AND RELATED ART

The present invention relates to a liquid container, an ink jet recording apparatus usable with the liquid container, and a liquid filling method for the liquid container.

In a type of the ink jet recording apparatus, a recording head scans the recording material, and the recording material is fed in a direction perpendicular to the scanning direction to form an image on the recording material. In a method for supplying the ink into the recording head scanning the recording material, an ink container is directly carried on a carriage on which the recording head is mounted, wherein the ink container is reciprocated together with the recording head along the scanning line (on-carriage type). In another method, a main container is placed at a fixed position outside the carriage, and the ink is supplied into a sub-container disposed on the carriage through a tube or the like (off-carriage type). In the case of the off-carriage type, the main container and the sub-container on the carriage is normally connected with each other, so that ink is always supplied in a type, and in another type, the main container and the sub-container are connected with each other when the necessity arises.

When the ink container is placed on the carriage (on-carriage type), the size of the reciprocable carriage is determined by the number of the kinds of the inks to be use, the amounts of the inks and the size of the recording head. When the number of the kinds of the ink increases, or when the amounts of the inks are increased, the weight of the carriage increases and the cross-sectional area also increases, so that size of the volume which moves for the scanning operation increases. Therefore, the type is suitable for a recording device used with a relatively small capacity ink or inks.

In the case that main container and the sub-container are normally connected with each other in an off-carriage type, a negative pressure generation method is generally used wherein the use is made with the static head difference between the main container and the recording head as shown in Japanese Laid-open Patent Application 2002-234180, for example. With such a method, the carriage can be downsized, and therefore, the volume of the parts which moves for the scanning operation is small, and therefore, the power for driving the part is not significantly increased, but there is a liability of load to the driving source depending on the rigidity of the tube. In some cases, the relative position between the main container and the sub-container are limited, and the influence of the pressure loss by the flow of the ink in the tube, and the pressure variation of the ink in the tube due to the reciprocation of the carriage may be significant. Therefore, when the apparatus is upsized, the structure of the apparatus should be considered. The same applies to the structure shown in Japanese Laid-open Patent Application Hei 8-300677, wherein the sub-container is closed and isolated from the ambient air, and therefore, the static head difference from the main container is used to impart a negative pressure to the recording head.

When the main container and the sub-container are connected with each other on-demand in an off-carriage type, the negative pressure when the ink is supplied into the recording head is produced solely by the sub-container. Therefore, the relative position between the main container and the sub-container are not limited, and the carriage can be small sized.

Among the ink supply methods wherein the main container and the sub-container are connected with each other by a tube, there is a method in which a valve is provided in the ink path by which the ink is supplied intermittently corresponding to the ink consumption. For example, in a method shown in Japanese Laid-open Patent Application Hei 10-157155, the pressure loss in the ink supply path or the influence by the reciprocation of the carriage can be suppressed as compared with the method in which the ink path is normally connected. However, depending on the rigidity of the tube, the load to the driving source is possibly increased.

In the case that main container and the sub-container are connected on-demand in the off-carriage type, the negative pressure may be produced solely by the sub-container using a spring force. In another method, the use is made with a sponge, fiber bundle or another ink absorbing material capable of producing a capillary force which is effective to produce a negative pressure. For example, Japanese Laid-open Patent Application Hei 10-128992 discloses the use of the spring force wherein the structure is complicated and the number of parts is relatively large. In the case of the use of the ink absorbing material as in Japanese Laid-open Patent Application 2001-301194, Japanese Laid-open Patent Application 2001-310477 and Japanese Laid-open Patent Application 2002-86754, the structure is simple.

FIG. 11 illustrates a conventional ink supply method using the ink absorbing material.

The sub-container 501 is connected on-demand by the joint portion 504 through the supply tube 503 with the main container 502. When the sub-container 501 and the main container 502 are connected with each other, the sub-container 501 is simultaneously connected by the pressure reduction joint portion 507 through the pressure reduction tube 506 with the pressure reduction pump 505. In the sub-container 501 more particularly in the absorbing material chamber 509, there is provided an ink absorbing material 508 impregnated with the ink, and the upper portion of the absorbing material chamber 509 is connected with the joint portion 507. Additionally, there are provided an air flow path 515 connected with the absorbing material chamber 508 through the water repellent porous film 510, and an ink flow path 516 connected with the recording head portion 512 through the filter 511.

The water repellent porous film 510 has pore size with which the liquid does not passes through the film unless a pressure difference beyond a predetermined level is imparted across the film and that water (liquid) repellent property is provided. The maximum pressure difference not permitting the passage of the liquid is generally called durable pressure. The water repellent porous film 510 passes the gas, and does not pass the liquid, and in this sense, it is call a gas-liquid separation film.

In addition to the water repellent porous film, the similar effect can be provided by the film having a surface monomolecule layer having an intermolecular distance which is larger than molecular size of the gas to be passed and is smaller than the molecular size of the liquid to be blocked. In such a case, the situation is equivalent to the film having pores through which the gas molecule can pass, and therefore, the film having such a monomolecular surface layer is one of the porous films in this specification and one type of the gas-liquid separation films.

The above-described applies to the structure in which the joint portion 504 is normally connected, and in such a case, the supply tube 503 is provided with a valve which is closed except for the ink supply, and the pressure reduction pump is in fluid communication with the ambient air except for the ink supply period. By doing so, the pressure in the sub-container 501 is maintained at the ambient pressure through the pressure reduction tube 506.

Other ink supply methods such as pressurizing the main container 502 side, changing the static head different between the main container 502 and the sub-container 501, or the like is usable.

Referring first to FIGS. 12*a*-12*d*, the description will be made as to a conventional ink supply method. FIG. 12 illustrates an operation principle of the conventional ink supply method of FIG. 11, wherein FIG. 12(*a*) shows a state in which the ink has been consumed up; Figure in (b) shows a state in which the ink supply is started; FIG. 12(*c*) shows a state in which the ink expands all over the ink absorbing material; and FIG. 12 (*d*) shows a state of end of the ink supply.

As shown in FIG. 12*a*, when the ink 513 in the ink absorbing material 508 in the sub-container 501 is consumed by the recording head portion 512, the gas-liquid interface 514 between the ink and the ambient air lowers.

When the ink 513 in the ink absorbing material 508 decreases to a predetermined extent, the supply tube 503 and the pressure reduction tube 506 are connected to the sub-container 501 through the joint portion 504 and the pressure reduction joint portion 507. Therefore, the pressure in the sub-container 501 is reduced by the pressure reduction pump 505, by which the ink is supplied into the sub-container 501 from the main container 502.

By maintaining the reduced pressure by the pressure reduction pump 505, the ink 513 expands all over the ink absorbing material 508, as shown in FIG. 12*c*. When the ink 513 is further supplied, the ink overflows beyond the ink absorbing material 508, and fills the space between the ink absorbing material 508 and the inner wall of the ink absorbing material chamber 509. Finally, as shown in FIG. 12*d*, the ink 513 reaches the gas-liquid separation film 510. Because of the water repellent property of the surface of the gas-liquid separation film 510, the ink 513 is unable to enter the gas-liquid separation film 510, and therefore, the ink supply stops when the ink 513 reaches the entire surface of the gas-liquid separation film 510. Thus, the inside of the sub-container 501, more particularly, the inside of the ink absorbing material chamber 509 is completely filled with the ink 513. The pressure reduction pump 505 automatically stopped after a preset time period determined empirically elapses.

The above-described operation is repeated each time the ink 513 in the sub-container 501 decreases, so that ink supply to the recording head portion 512 is maintained.

The type in which the ink absorbing material 508 is accommodated in the sub-container 501 is advantageous in that structure is simple, and the cost is low. However, durability of the water repellent porous film 508 may be a problem depending on the structure of the sub-container 501 in terms of the gas-liquid separation.

The possible problem has been investigated. After the liquid reaches the water repellent porous film 508 (liquid-gas separation film) as a result of the exhaustion of the air in the ink absorbing material chamber 509, an excessively high pressure is concentratedly applied to a point of the porous film 508 upon all the air contacting the water repellent porous film 508 passes through the porous film 508.

Using FIGS. 13*a*-13*d*, the phenomenon will be described in detail. FIGS. 13*a*-13*d* are enlarged sectional views of a part B of the water repellent porous film 510 shown in FIG. 12. FIG. 13*a* shows a state immediately before the ink 513 comes to contact to the water repellent porous film 510, and FIG. 13*b* shows a state immediately after a part of the ink 513 reaches the water repellent porous film 510, by which a bubble 520 is formed. FIG. 13*c* shows a state in which the size of the bubble 520 reduces with continuing ink supply.

As shown in FIG. 13*a*, the ink 513 is supplied into the sub-container 501 by the pressure reduction, and the surface of the ink, namely, the gas-liquid interface 522 approaches to the water repellent porous film 508 (gas-liquid separation film), and the ink 513 is further supplied into the sub-container 501. As a result, as shown in FIG. 13*b*, the ink 513 reaches a part of the porous film 510, and the remainder air is formed into a bubble due to the water repellent property of the porous film 510. With the maintained pressure reduction, the air in the bubble 520 passes through the porous film 510, so that size of the bubble 520 gradually reduces as shown in FIG. 13*c*, and the supply of the ink 513 stops upon the dissipation of the bubble 520, as shown in FIG. 13*d*.

As shown in FIGS. 13*b*, 13*c* and 13*d*, when the ink flows into the chamber, the ink 513 contacting to the gas-liquid interface 522 relative to the bubble 520 moves in a direction substantially perpendicular to the gas-liquid interface 522, and the speed vector 524 thereof is determined by the amount, per unit time, of the gas passing through the gas-liquid separation film. With the reduction of the size of the bubble 520, the contact area of the gas to the film decreases, and therefore, the amount, per unit time, of the gas passing through the film decreases, but due to the inertia of the movement of the liquid, the speed in the direction perpendicular to the gas-liquid interface does not decrease immediately, and for this reason, the internal pressure of the bubble rises. The internal pressure of the bubble becomes maximum immediately before the dissipation of the bubble. This causes an impact to the porous film 510 at the point 526 of bubble dissipation. The impact force may exceed the hydraulic-pressure-resistance of the porous film 510, and then the meniscus formed in the pores of the porous film 510 are broken with the result that ink 513 enters the porous film 510. It has been found that impact upon the dissipation of the bubble may break the material to expand the effective pore sizes to lead the ink entering into the film, in some cases. If the ink 513 enters the porous film 510, the ink 513 stays in the porous film 510.

By the repetition of the entering of the ink, the amount of the ink 513 in the porous film 510 increases. As a result, the area in the porous film 510 capable of passing the air decreases so that pressure loss upon the passage of the air through the porous film 510 increases, that is, the gas permeability decreases.

With further entering of the ink 513, the ink 513 passes through the porous film 510, so that gas-liquid separation function of the porous film 510 is partly lost with the result of exudation of the ink 513 to the outside.

This phenomenon can be avoided to a certain extent by scattering the dissipation point. By doing so, the localized collision of the ink is eased.

In the foregoing, the description has been made as to the ink supply method using the capillary force of the ink absorbing material in the sub-container accommodating the ink absorbing material. The gas-liquid separation film is usable to remove the bubble in the sealed space containing the ink in the system wherein the negative pressure is generated using a spring elastic force. Then, the phenomenon upon the removal of the bubble is the same in this case.

SUMMARY OF THE INVENTION

Accordingly, it is a principal object of the present invention to provide a liquid container, an ink jet recording apparatus and liquid filling method for the liquid container wherein collision of liquid to a gas-liquid separation film is suppressed.

According to and aspect of the present invention, a liquid container comprising a liquid containing portion for containing ink; a liquid introduction portion for introducing the ink into the liquid containing portion; a liquid discharge portion for discharging the ink to an outside from an inside of said liquid containing portion; a gas-liquid separation film; a gas-liquid blocking portion disposed adjacent to said gas-liquid separation film; wherein said gas-liquid separation film and said gas-liquid blocking portion are constructed such that when the ink is introduced into said liquid containing portion by discharging gas in said liquid containing portion through said gas-liquid separation film, a contact line where a gas-liquid interface between the ink and the gas contacts said gas-liquid separation film moves toward a boundary between said gas-liquid separation film and said gas-liquid blocking portion.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3(*b*) shows a state after a part of the ink reaches the water repellent porous film; and FIG. 3(*c*) shows a state wherein the ink supply has been carried out, and the ink supply is stopped.

FIG. 5(*a*) shows a state immediately before the reaching of the ink liquid surface to the opening formed in the ceiling wall, and FIG. 5(*b*) shows a state in which the ink enters the opening, and the ink liquid surface reaches the gas-liquid separating member; FIG. 5*c* shows a state in which the ink is supplied so that ink liquid surface is rising; and FIG. 5(*d*) shows a state in which the ink supply is stopped.

FIG. 8(*a*) shows a state immediately before the ink liquid surface reaches the opening formed in the ceiling wall; FIG. 8(*b*) shows a state in which the ink liquid surface is rising in contact to the water repellent porous film of the gas-liquid separating member; and FIG. 8(*c*) shows the state in which the ink supply stops.

FIG. 10(*a*) shows a state immediately before the ink liquid surface reaches the opening formed in the ceiling wall; FIG. 10(*b*) shows a state immediately after a part of the ink 513 reaches the water repellent porous film 510, and a bubble 520 is formed; and FIG. 10(*c*) shows a state in which the ink supply stops.

FIG. 12(*c*) shows a state in which the ink expands all over the ink absorbing material; and FIG. 12(*d*) shows a state of end of the ink supply.

FIG. 13(*b*) shows a state immediately after a part of the ink reaches the water repellent porous film, and bubbles are formed; FIG. 13(*c*) shows a state in which the size of the bubbles reduces with the ink supply; and FIG. 13(*d*) shows the state in which the bubble dissipates.

DESCRIPTION OF THE PREFERRED EMBODIMENTS

Referring to the accompanying drawing, the preferred embodiments of the present invention will be described.

First Embodiment

Figure 1:
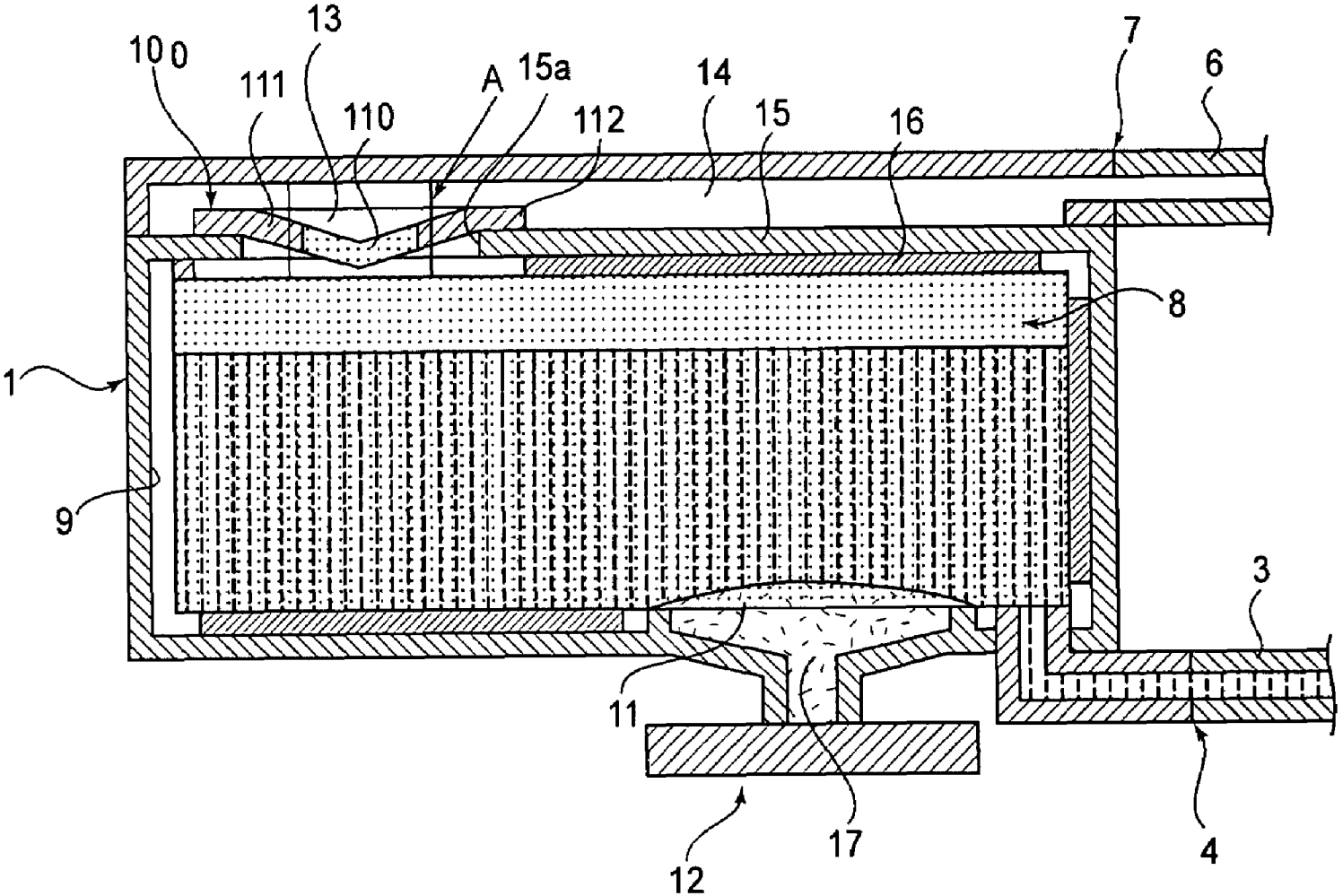
FIG. 1 is a schematic sectional view of a sub-container according to a first embodiment of the present invention.
Figure 2:
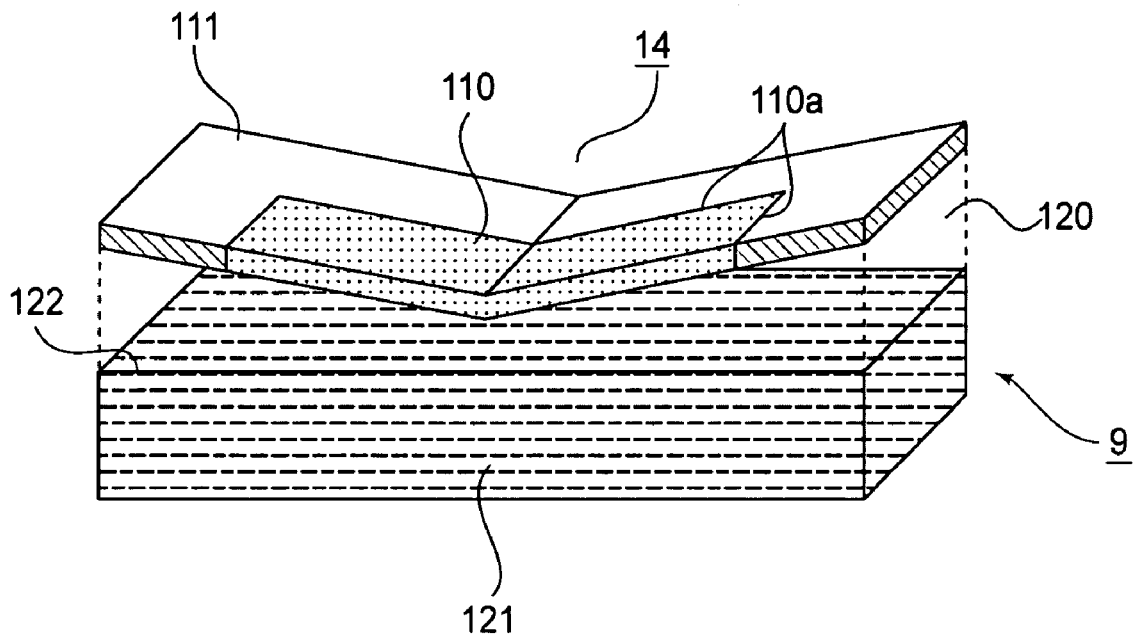
FIG. 2 is an enlarged perspective view of a major part An of a gas-liquid separating member provided in the sub-container of FIG. 1.
Figure 3:
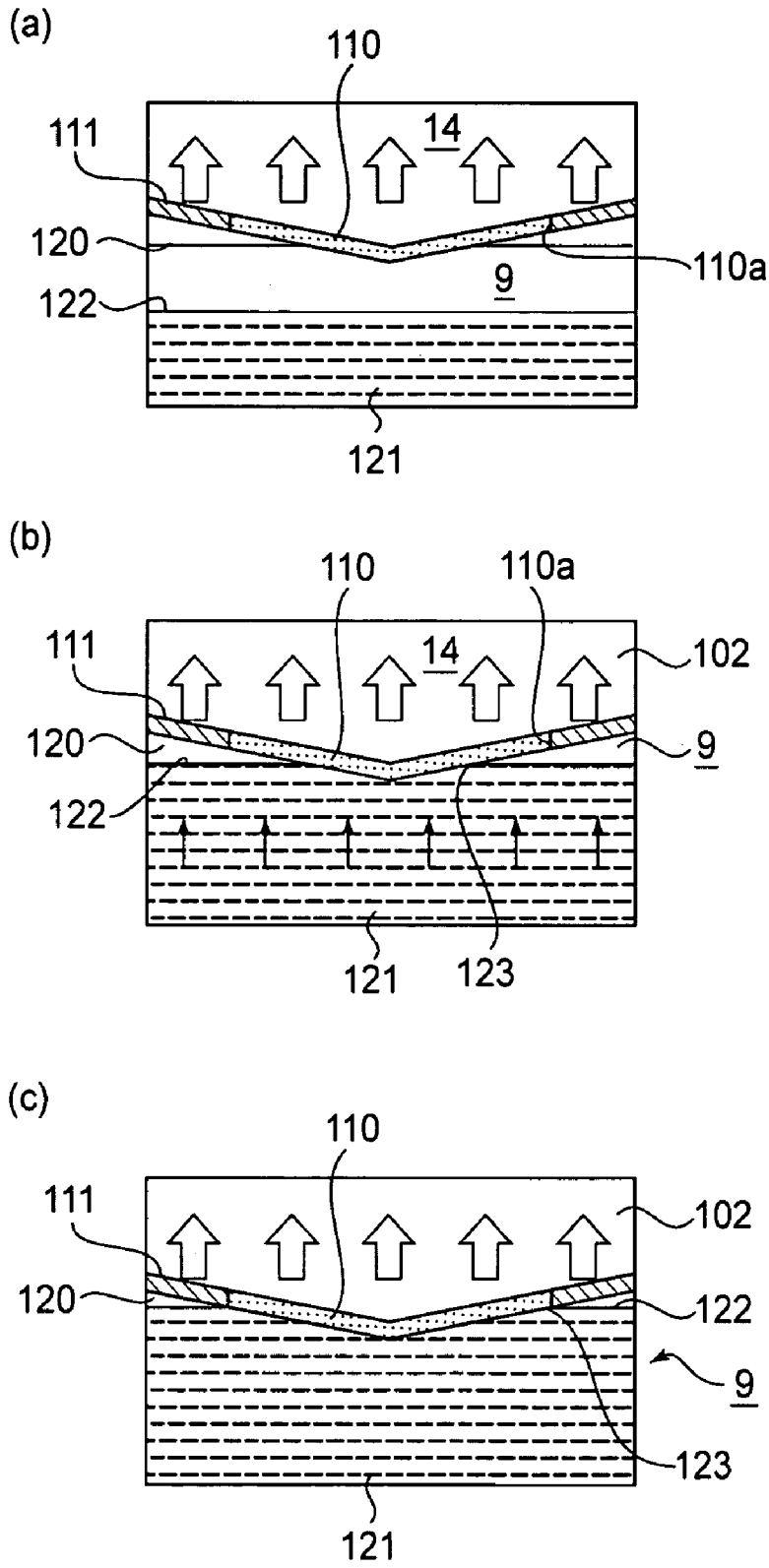
FIGS. 3(*a*)-3(*c*) are an enlarged sectional view of the part An of the gas-liquid separating member of FIG. 1 to illustrate an operation during ink supply and filling operations, wherein FIG. 3 (*a*) shows a state immediately before the ink contacts a water repellent porous film of the gas-liquid separating member.

FIG. 1 is a schematic sectional view of a sub-container according to an embodiment of the present invention, and FIG. 2 is an enlarged perspective view of a major part An of a gas-liquid separating member provided in the sub-container of FIG. 1. FIGS. 3*a*-3*c* are an enlarged sectional view of the part An of the gas-liquid separating member of FIG. 1 to illustrate an operation during ink supply and filling operations, wherein FIG. 3*a* shows a state immediately before the ink contacts a water repellent porous film of the gas-liquid separating member; FIG. 3*b* shows a state after a part of the ink reaches the water repellent porous film; and FIG. 3*c* shows a state wherein the ink supply has been carried out, and the ink supply is stopped.

Figure 11:
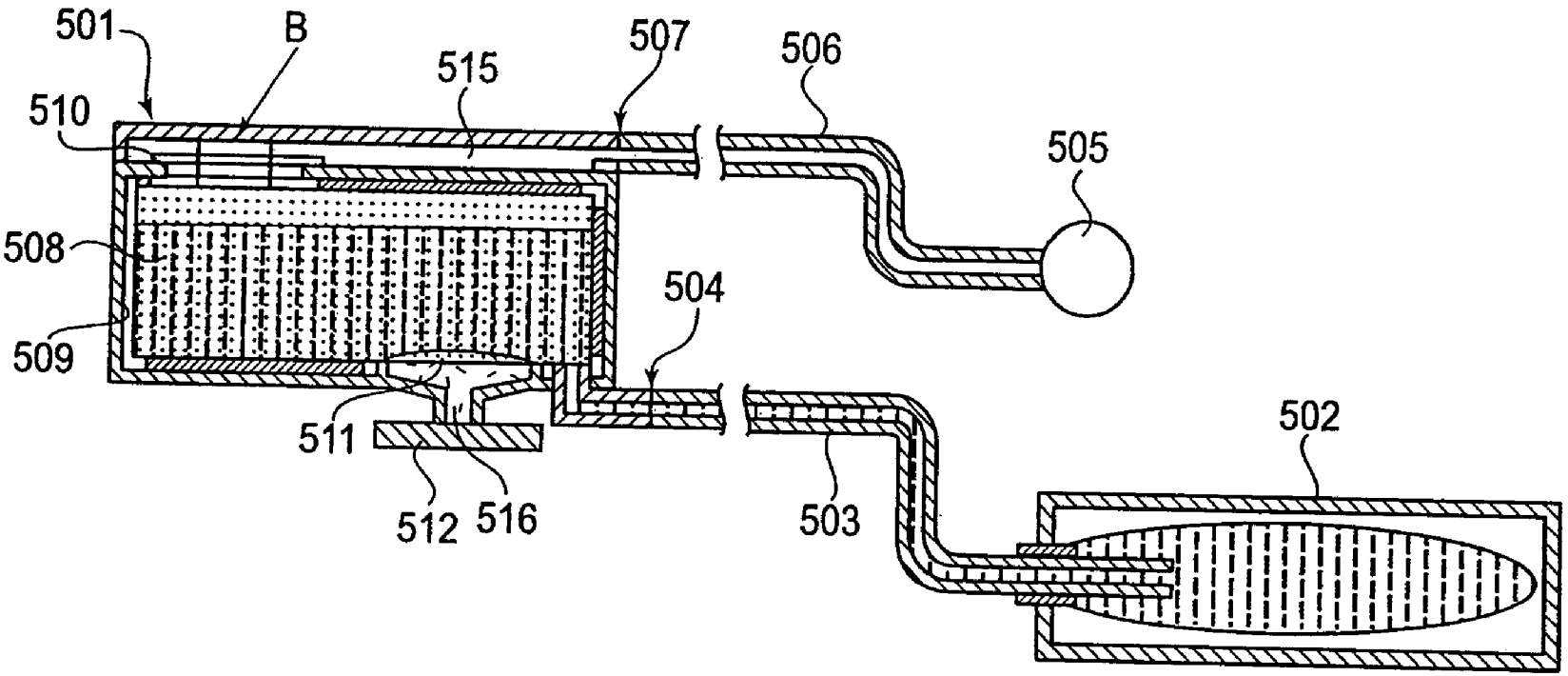
FIG.11 (PRIOR ART)
FIG. 11 is a schematic view illustrating a conventional ink supply method.
Figure 12:
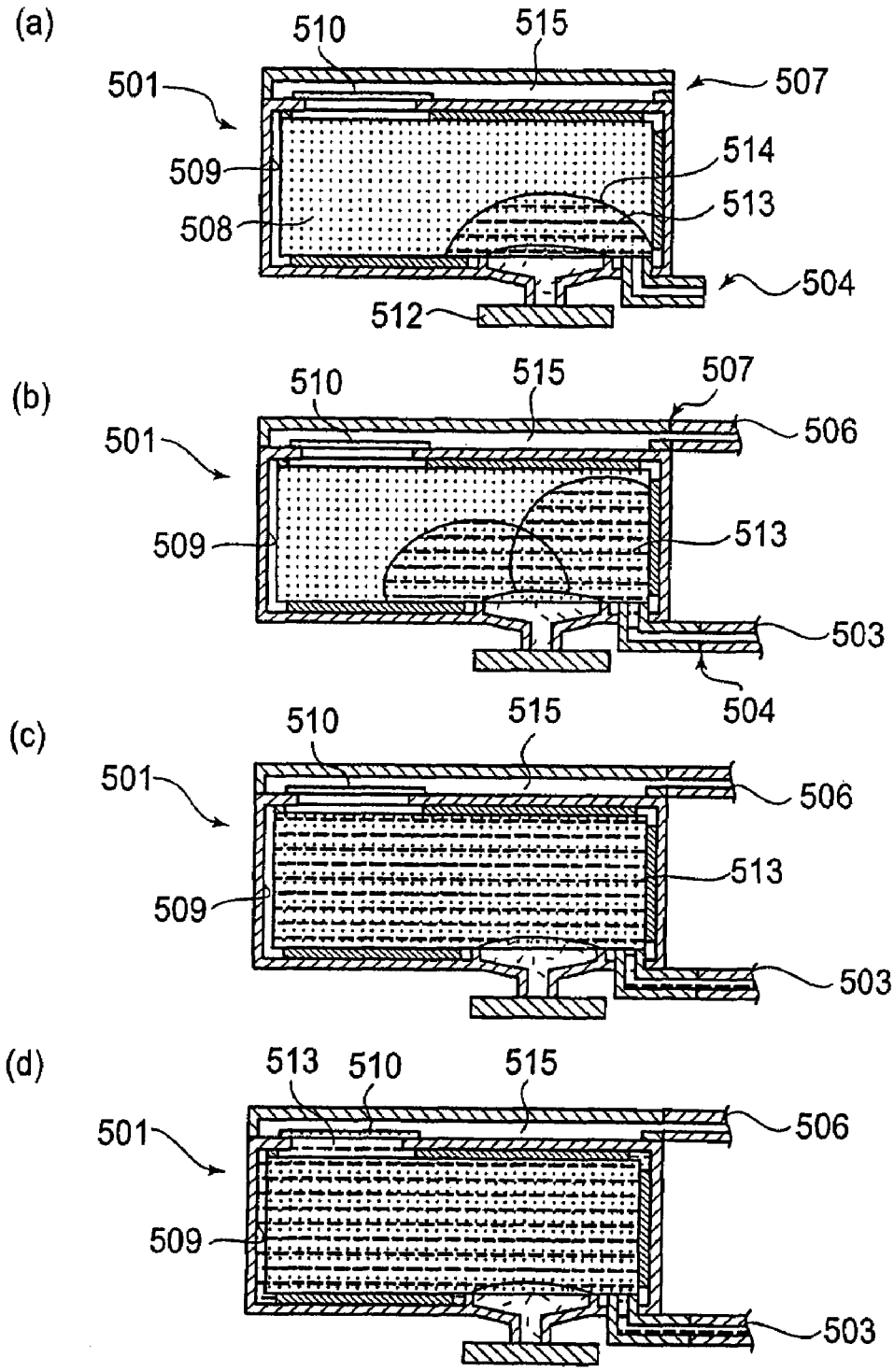
FIG.12 (PRIOR ART)
FIG. 12 illustrates an operation principle of the conventional ink supply method of FIG. 11, wherein FIG. 12(*a*) shows a state in which the ink has been consumed up; Figure in (b) shows a state in which the ink supply is started.
Figure 13:
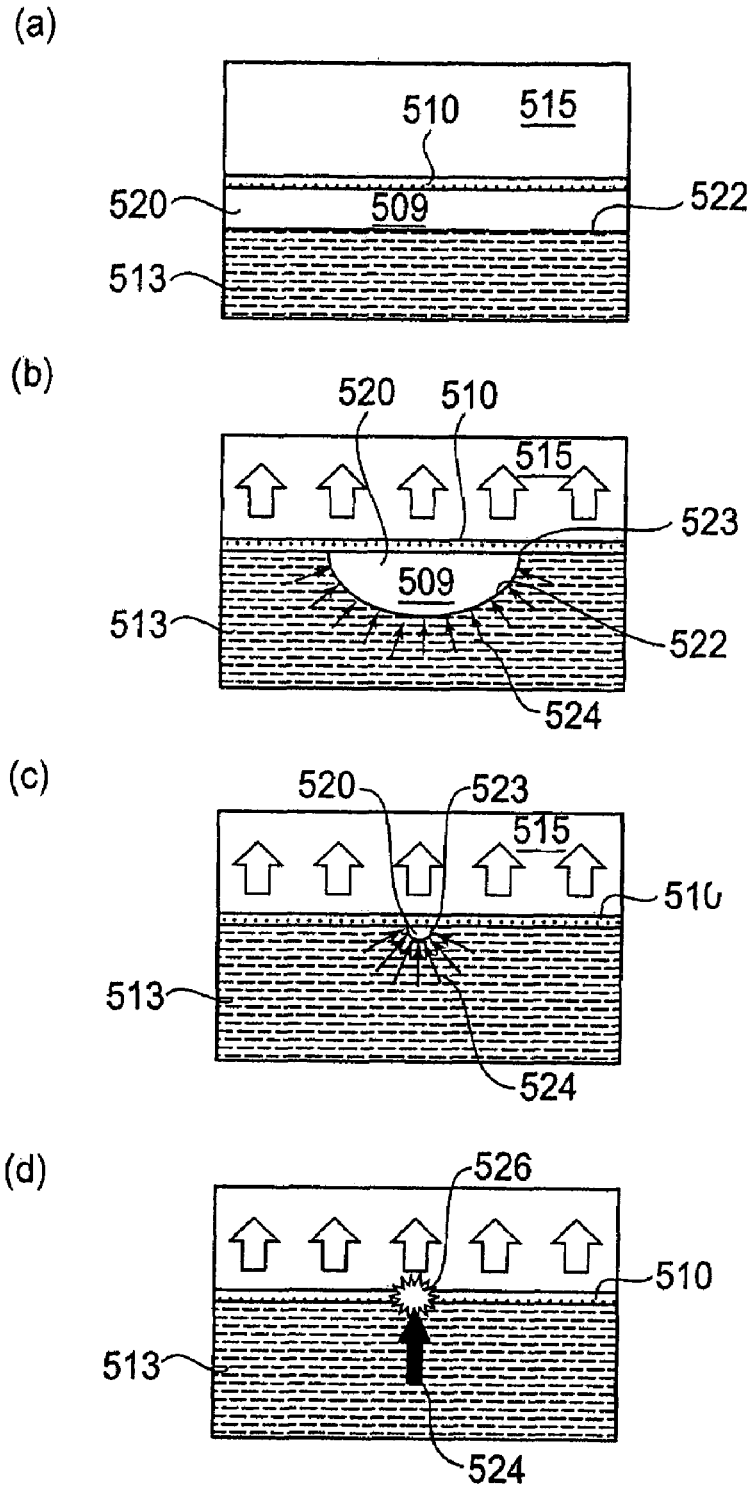
FIG.13 (PRIOR ART)
FIG. 13(*a*) is an enlarged sectional view of a part B of the water repellent porous film used in the conventional ink supply method illustrated in FIG. 11, wherein 13*a* shows a state immediately before the ink contacts the water repellent porous film.

As shown in FIG. 1, the ink supply mechanism of the present invention is different in the structure of the gas-liquid separating member (gas-liquid separating mechanism), and the other structures are substantially the same as the structures shown in FIG. 11.

In FIG. 1, designated by reference numeral 1 is a sub-container; 3 is an ink supply tube connecting the sub-container 1 and the main container (unshown) with each other; 4 is a joint portion (ink introduction portion); 6 is a pressure reduction tube connecting the sub-container 1 with the pressure reduction pump (unshown). Designated by 7 is a pressure reduction joint portion; 8 is an ink absorbing material; 9 is an ink absorbing material chamber (ink accommodating portion); 11 is a filter (ink discharge portion); 12 is a recording head portion; 14 is an air passage connecting to the pressure reduction joint portion 7. Further, designated by 15 in addition a ceiling wall separating between the ink absorbing material chamber 9 and the air passage 14; 16 is an absorbing material holding member in the form of a rib contacting to the ink absorbing material 8 and reinforcing the ceiling wall 15; 17 is an ink passage for supplying the ink from the ink absorbing material 8 to the recording head portion 12. Designated by 100 is a gas-liquid separating member in the present invention, and is mounting in the ceiling wall 15 to plug the opening 15*a* of the ceiling wall 15 as shown in FIG. 1.

The gas-liquid separating member 100 of this embodiment has an outer configuration corresponding to the opening 15*a* so as to completely close the opening 15*a* formed in the ceiling wall 15 of the ink absorbing material chamber 9. For example, it comprises a flat outer horizontal portion 112 to be fixed to the ceiling wall 15 by heat welding, the inner part of the outer horizontal portion 112, as shown in FIG. 1, is inclined from the outer horizontal portion 112 toward the center, and has a configuration projecting in the direction of the gravity as seen from the side, thus constituting a V-shaped configuration. The lateral ends (end with respect to the direction perpendicular to the sheet of the drawing of FIG. 1) of the V-shaped portion is closed by a vertical blocking side wall 113. As clearly shown in FIG. 2, the central portion of the V-shaped portion of the gas-liquid separating member 100 is made of a water repellent porous film 110 having a gas-liquid separation function by which on the gas is passed therethrough. The outer periphery portion around the water repellent porous film 110 is a blocking portion 111 which does not pass the gas or liquid. Designated by 110*a* is a boundary line between the water repellent porous member 110 and the blocking portion 111. With such a structure of the gas-liquid separating member 100, the water repellent porous film 110 provided at the central portion also has a V-shaped cross-section, and the line 11*a* is an apex line of the V-shape water repellent porous film 110 adjacent the ink absorbing material chamber 9. The manufacturing method of the gas-liquid separating member 100 is not particularly limited, but in an example, the entirety thereof is made of a water repellent porous film, a non-transmitting material, that is, blocking material is contacted to the blocking portion 111, or a sealing material is applied to the blocking portion 111 of the water repellent porous film. The angles of the V-shaped portions of the water repellent porous film 110 and the blocking portion 111 is preferably close to 180°.

Referring to FIGS. 3*a*-3*c*, the description will be made as to the operation when the ink 121 (liquid) is supplied or filled into the sub-container 1.

When the ink is supplied into the sub-container 1 more particularly into the ink absorbing material chamber 9, the air passage 14 is connected to the pressure reduction pump, and therefore, the pressure in the air passage 14 is reduced, by which the gas (air) 120 in the ink absorbing material chamber 9 is discharged to the outside through the water repellent porous film 110. The ink 121 is supplied into the ink absorbing material chamber 9 through the supply tube 3 connected to the main container. With the ink supply continuing, the liquid surface of the ink 121 in the ink absorbing material chamber 9, that is, the gas-liquid interface 122 therein rises (FIG. 3*a*).

When the gas 120 is sufficiency discharged from the ink absorbing material chamber 9, and the ink supply is carried out, the ink liquid surface (gas-liquid interface) 122 first contacts to the apex line 110*a* of the water repellent porous film 110. With further continuation of the ink supply, the contact line 123 between the surface of the water repellent porous film 110 and the gas-liquid interface 122 is divided into two parts with the rising of the ink liquid surface (gas-liquid interface), and the two contact lines moves along the inclined surfaces of the water repellent porous film 110 (FIG. 3*b*). When the contact line 123 of the gas-liquid interface 122 reaches the boundary line 110*a* between the water repellent porous film 110 and the blocking portion 111, the gas 120 is not discharged or exhausted from the ink absorbing material chamber 9, by which the ink supply stops. At this time, the inside of the ink absorbing material chamber 9 is filled with the ink 121. At the time of the stop of the ink supply, the air is trapped between the blocking portion 111 and the gas-liquid interface 122 in the ink absorbing material chamber 9, and the trapped air does not dissipate. Therefore, no impact is produced due to the collision of the ink 121 to the water repellent porous film 110, thus expanding the lifetime of the water repellent porous film 110.

During the ink consumption for the printing, the operation is opposite from that during the ink filling. More particularly, with the consumption of the ink 121 by the recording head portion 12, the top level surface of the ink (gas-liquid interface 122) lowers, by which the contact lines 123 between the gas-liquid interface 122 and the water repellent porous film 110 move in the direction opposite the direction during the ink filling operation. The movements of the contact lines 123 is effective to rinse the surface of the water repellent porous film 110 by which the foreign matter accumulating during the ink filling is removed from the water repellent porous film 110. Therefore, the clogging of the water repellent porous film 110 due to the repeated accumulation of the foreign matter is prevented, so that possible increase of the pressure loss during the ink supply from the main container 2 into the sub-container 1, attributable to the clogging of the water repellent porous film 110, can be suppressed. In this sense, too, the lifetime of the water repellent porous film 110 can be expanded, and therefore, the lifetime of the ink jet recording apparatus can be expanded.

In this embodiment, the portion of the gas-liquid separating member 100 constituted by the water repellent porous film 110 and the blocking portion 111 is V-shaped with the apex line 110*a*, but the present invention is not limited to this particular shape. The portion constituted by the water repellent porous film 110 and the blocking portion 111 of the gas-liquid separating member 100 may be such that apex of the V-shaped portion may be rounded, may be pyramid configuration, conical shape, semi-spherical configuration or the like. Any structure or configuration is usable if the water repellent porous film and the blocking portion continue with each other with an inclination, by which the contact line between the gas-liquid interface and the water repellent porous film moves to the boundary between the water repellent porous film and the blocking portion.

Second Embodiment

Figure 4:
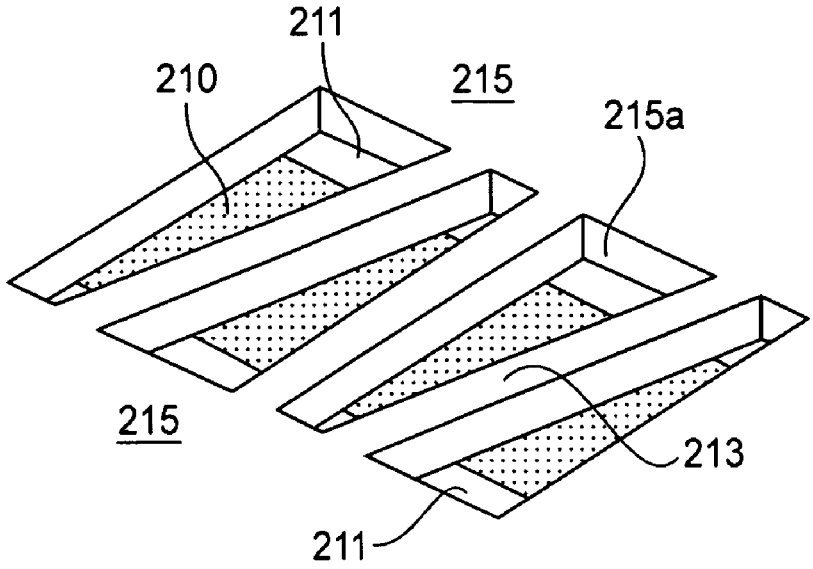
FIG. 4(*a*) and FIG. 4(*b*) show a second embodiment of the present invention, and FIG. 4(*a*) is a perspective view of the gas-liquid separating member as seen from the ink absorbing material chamber, and FIG. 4(*b*) is an enlarged sectional view of the major part adjacent the gas-liquid separating member including the gas-liquid separating portion.
Figure 4:
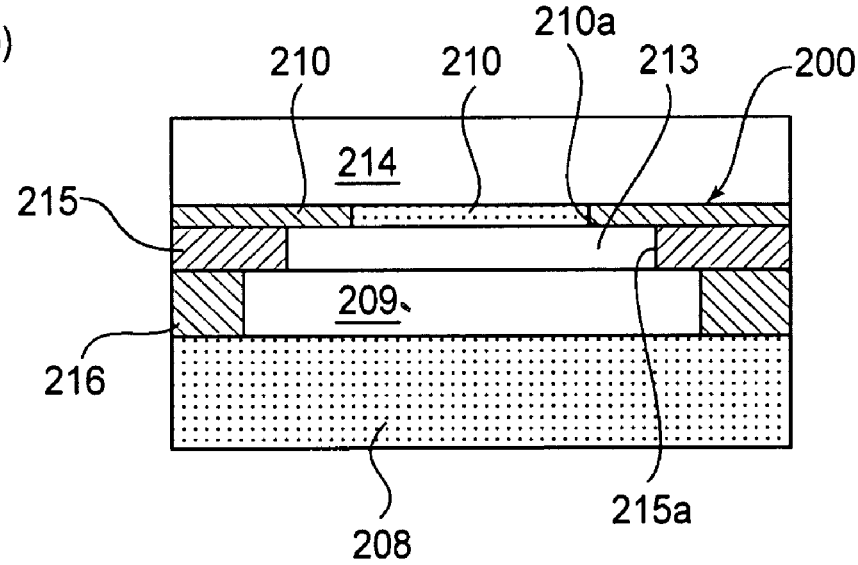
Figure 5:
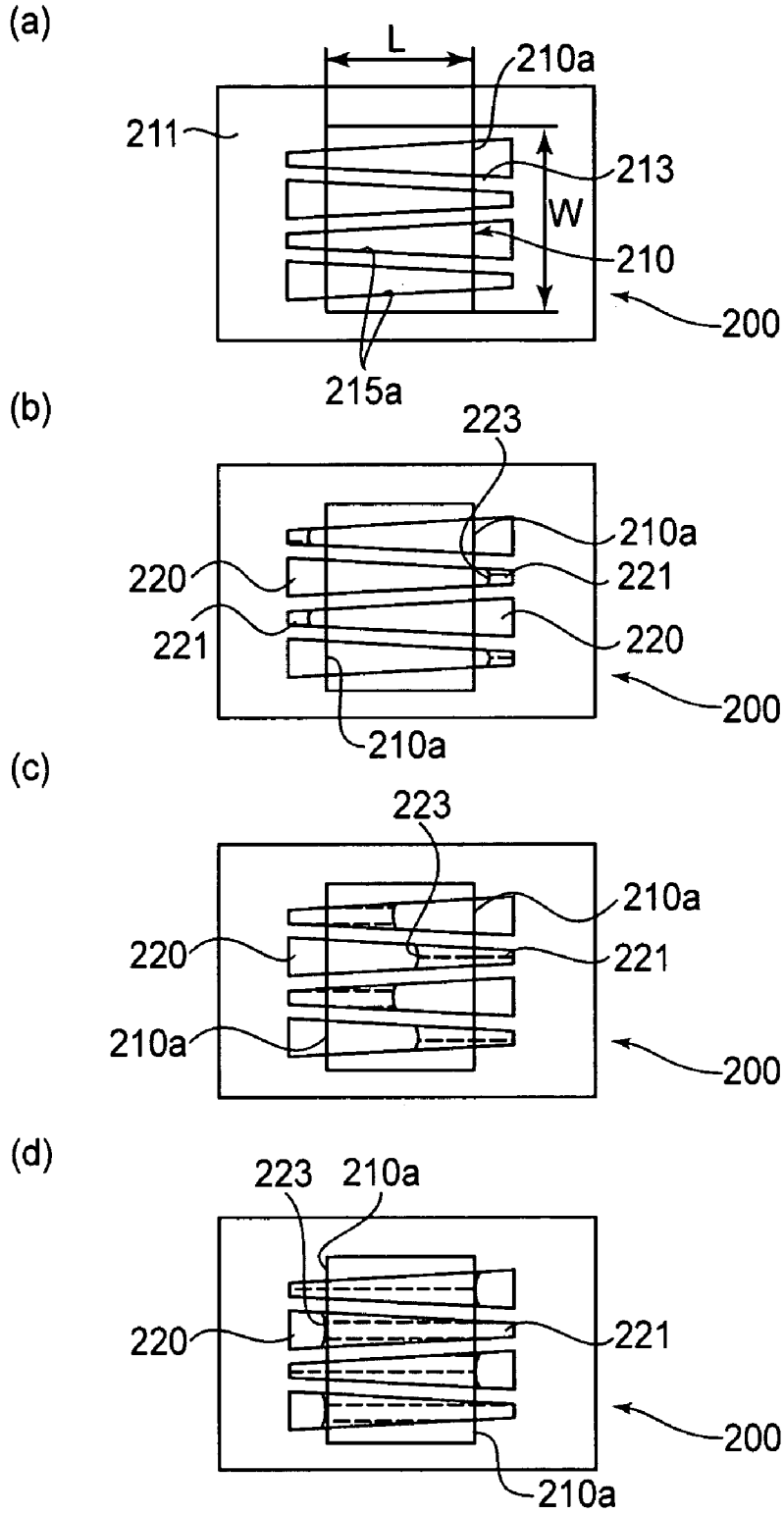
FIGS. 5(*a*)-5(*d*) are schematic perspective views of the gas-liquid separating member as seen from the air passage side to illustrate the operation during the ink supply and filling in this embodiment.

FIG. 4*a* and FIG. 4*b* show a second embodiment of the present invention, and FIG. 4*a* is a perspective view of the gas-liquid separating member as seen from the ink absorbing material chamber, and FIG. 4*b* is an enlarged sectional view of the major part adjacent the gas-liquid separating member including the gas-liquid separating portion. FIGS. 5*a*-5*d* are schematic perspective views of the gas-liquid separating member as seen from the air passage side to illustrate the operation during the ink supply and filling in this embodiment. FIG. 5*a* shows a state immediately before the reaching of the ink liquid surface to the opening formed in the ceiling wall, and FIG. 5*b* is shows a state in which the ink enters the opening, and the ink liquid surface reaches the gas-liquid separating member. FIG. 5*c* shows a state in which the ink is supplied so that ink liquid surface is rising, and FIG. 5*d* shows a state in which the ink supply is stopped.

In FIGS. 4*a* and 4*b*, designated by reference numeral 200 is a gas-liquid separating member in this embodiment; 210 is a water repellent porous film; 211 is a non-transmitting portion, that is, a blocking portion; 215*a* is openings formed in the ceiling wall 215; 213 is a rib separating the openings 215*a*; 216 is an absorbing material holding member in the form of a rib. The other structures are substantially the same as in the first embodiment.

The openings 215*a* formed in the ceiling wall 215 constituting the upper wall of the ink absorbing material chamber 209 are spaces interposed between the adjacent ribs 213, and as shown in FIGS. 4*a* and 5*a*, the width changes (inclination) to form a trapezoidal configuration. For example, they are foamed by punching the ceiling wall 215. The trapezoidal openings 215*a*, as shown in FIGS. 4*a* and 5*a*, may be arranged with alternating short side and long side adjacent to each other, by which the plurality of openings 215*a* can be efficiently arranged in a limited space. However, such arrangement is not inevitable.

In this embodiment, the gas-liquid separating member 200 is in the form of a flat rectangular plate-like member large enough to cover all of the plurality of openings 215*a*, and the central portion thereof is provided with a rectangular water repellent porous film 210 having a length L and a width W. The outer periphery surrounding the rectangular water repellent porous film 210 is constituted as a blocking portion 211 not passing the gas or liquid. The length L of the water repellent porous film 210 is smaller than the length of the trapezoidal opening 215*a*, and the width W is larger than the width of the region in which the plurality of openings 215*a* are formed as shown in FIG. 5*a*.

As shown in FIG. 4*b*, the gas-liquid separating member 200 is welded by heat on the ceiling wall 215 from the air passage 214 side to close the opening 215*a* such that boundary line 210*a*, in the widthwise direction, between the water repellent porous member 210 and the blocking portion 211 is inside the large side of the opening 215*a*.

Referring to FIGS. 5*a*-5*d*, the description will be made as to the operation when the ink 121 is supplied and filled into the sub-container.

When the ink is supplied into the sub-container more particularly into the ink absorbing material chamber 209, the pressure in the air passage 214 is reduced since the air passage 214 is connected with the pressure reduction pump. By this, the gas (air) 220 in the ink absorbing material chamber 209 is discharged to the outside through the water repellent porous film 210 similarly to the first embodiment. The ink 221 is supplied into the ink absorbing material chamber 209 through the supply tube connected to the main container. With the ink supply continuing, the liquid surface of the ink 221 in the ink absorbing material chamber 209, that is, the gas-liquid interface therein rises (FIG. 5*a*).

When the gas 220 is sufficiency exhausted from the inside of the ink absorbing material chamber 209, and the ink supply is carried out, the ink liquid surface (gas-liquid interface) reaches the lower surface of the ceiling wall 219 along the absorbing material holding portion 216. At this time, the ink 221 enters the opening 215*a* from the portion where the space between adjacent ribs 213 is small, that is, the shorter width portion of the opening 215*a*, due to the capillary force (FIG. 5*b*).

Thereafter, with the continuing ink supply, the ink liquid surface (gas-liquid interface) rises slightly inclinedly in the opening 215*a* from the short side toward the large side due to the difference in the capillary force determined by the gaps between adjacent ribs. Thus, in this embodiment, similarly to the first embodiment, the water repellent porous film 210 closing the opening 215*a* is relatively inclined relative to the gas-liquid interface. Therefore, contact lines 223 where the gas-liquid interface and the water repellent porous film 210 contact to each other are provided, and the contact lines 223 move along the relatively inclined water repellent porous film 210 (FIG. 5*c*).

When the contact lines 223 between the gas-liquid interface and the water repellent porous film 210 reaches the boundary line 210*a* between the water repellent porous film 210 and the blocking portion 211, the gas 220 in the ink absorbing material chamber 209 is no longer discharged. So, the ink supply stops with the ink absorbing material chamber 209 is filled with the ink 221 (FIG. 5*d*). At the time of the stoppage of the ink supply, the air is trapped between the blocking portion 211 and the gas-liquid interface in the ink absorbing material chamber 209 more particularly in the opening 215*a*, but the trapped air does not dissipate. Therefore, the impact resulting from the collision of the ink 221 to the water repellent porous film 210 can be avoided.

According to this embodiment, the gas-liquid separating member 200 including the water repellent porous film 210 is flat, so that mounting is easy. In addition, the movement of the contact line 223 between the water repellent porous film 210 and the gas-liquid interface is not in the vertical direction (height direction) but is horizontal direction relative to the water repellent porous film 210, and therefore, the required volume can be saved.

Third Embodiment

Figure 6:
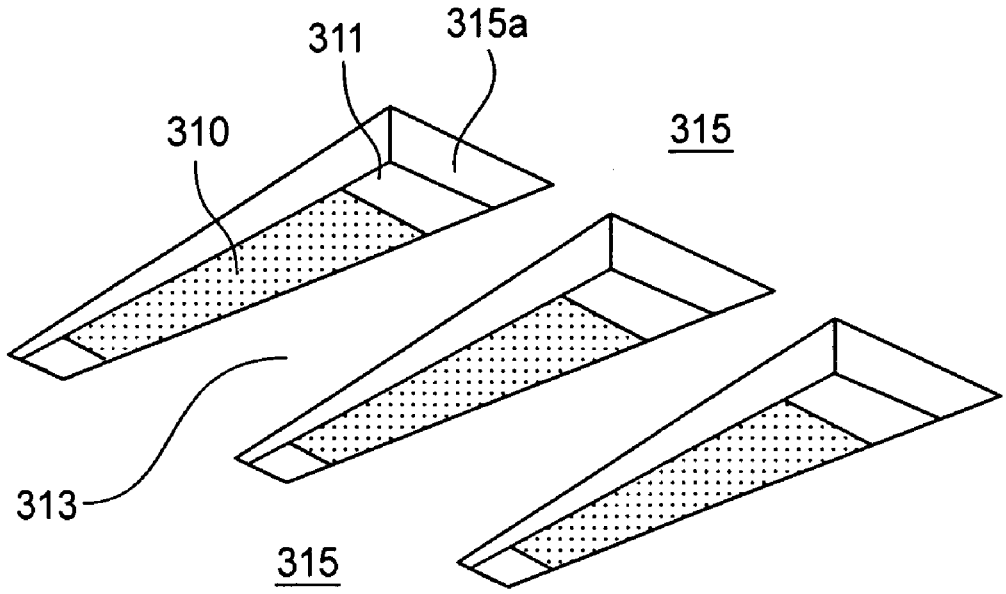
FIG. 6 is a perspective view of a gas-liquid separating member according to a third embodiment of the present invention as seen from an ink absorbing material chamber side.
Figure 7:
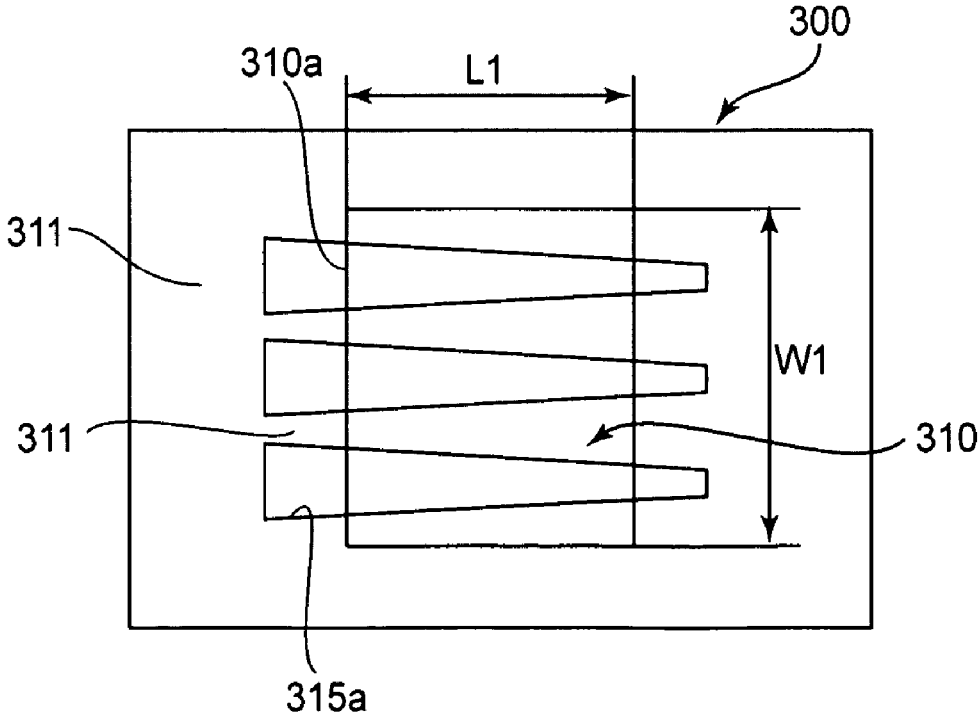
FIG. 7 is a schematic perspective view of the gas-liquid separating member of FIG. 6 as seen from an air passage side.
Figure 8:
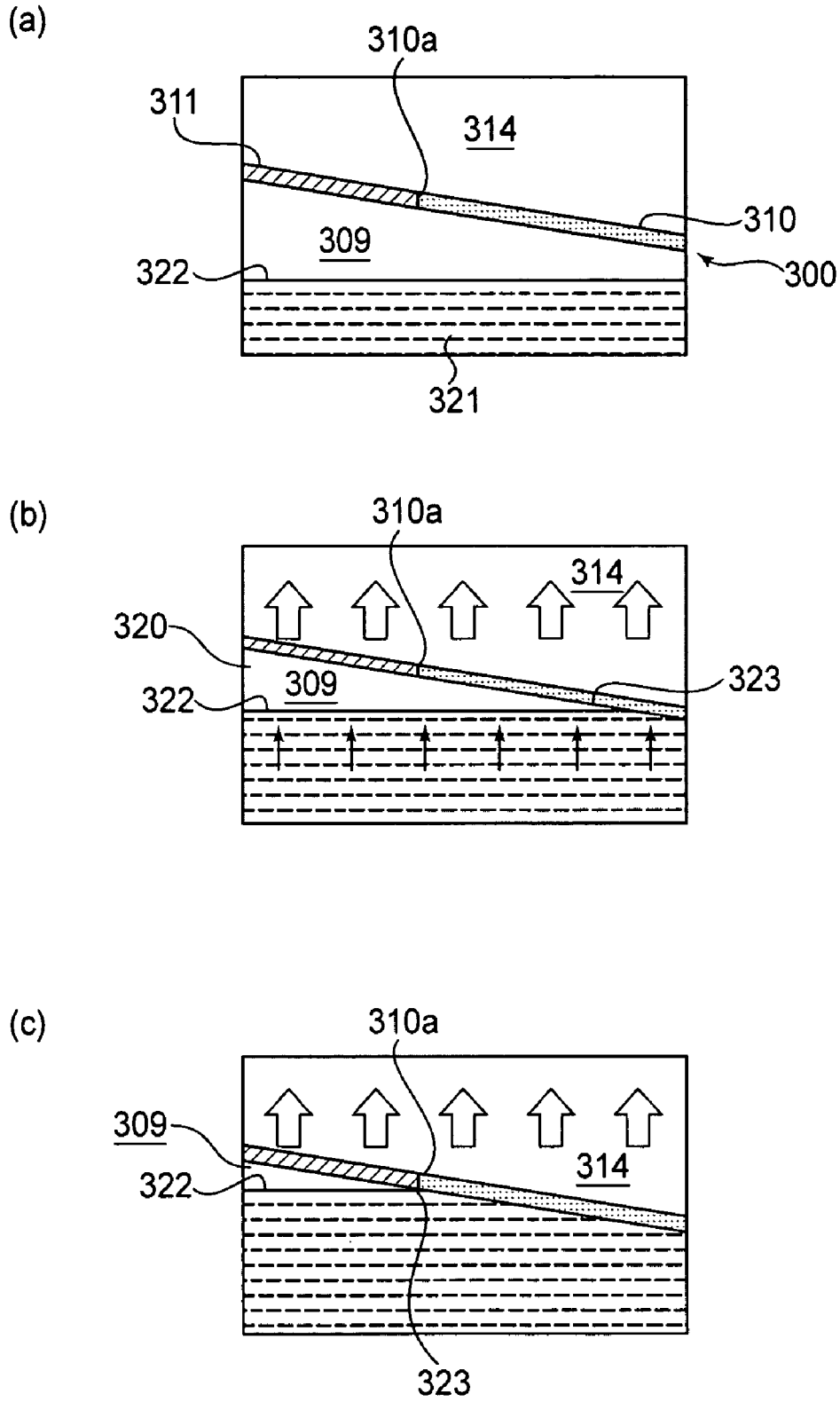
FIG. 8(*a*)-8(*s c*) are enlarged sectional views of a major part of the gas-liquid separating member of this embodiment to illustrate the operation during the ink supply and filling operation in this embodiment.

FIGS. 6 and 7 show a third embodiment of the present invention, and FIG. 6 is a perspective view of the gas-liquid separating member as seen from the ink absorbing material chamber side, and FIG. 7 is a schematic perspective view of the gas-liquid separating member as seen from the air passage side. FIGS. 8*a*-8*c* are enlarged sectional views of a major part of the gas-liquid separating member of this embodiment to illustrate the operation during the ink supply and filling operation in this embodiment. FIG. 8*a* shows a state immediately before the ink liquid surface reaches the opening formed in the ceiling wall; FIG. 8*b* shows a state in which the ink liquid surface is rising in contact to the water repellent porous film of the gas-liquid separating member; and FIG. 8*c* shows the state in which the ink supply stops.

In FIGS. 6 and 7, designated by 300 is a gas-liquid separating member in this embodiment; 310 is a water repellent porous film; 311 is a blocking portion; 315*a* are a plurality of opening formed in the ceiling wall 315; and 313 is a rib separation between the adjacent opening 315*a*.

The openings 315*a* formed in the ceiling wall 315 constituting the upper wall of the ink absorbing material chamber 309 are defined by the adjacent ribs 313. As clearly shown in FIGS. 6 and 7, the width changes (inclination) to form a trapezoidal configuration similarly to the second embodiment. However, in this embodiment, the openings 315*a* are inclined as seen from the side such that portion where the gap between the adjacent ribs 313, that is, the width of the opening 315*a* is relatively larger takes an upper position than the shorter side.

Additionally, this embodiment is different from the second embodiment in that openings 315*a* are arranged with the large width sides aligned at one side, as shown in FIGS. 6 and 7, since the opening 315*a* is inclined. It is possible to arrange the openings 315*a* alternately as in the second embodiment, but if this is done, the structure is complicated.

In this embodiment, the gas-liquid separating member 200 is in the form of a rectangular plate-like member large enough to cover all of the plurality of opening 3*s* 15*a*, and the central portion thereof is provided with a rectangular water repellent porous film s10 having a length L1 and a width W1. The outer periphery surrounding the rectangular water repellent porous film 310 is constituted as a blocking portion 311 not passing the gas or liquid. The length L1 of the water repellent porous film 310 is smaller than the length of the trapezoidal opening 315*a*, and the width W is larger than the width of the region in which the plurality of opening 3*s* 15*a* are formed as shown in FIG. 6. The gas-liquid separating member 300 in this embodiment, the portion corresponding to the opening 315*a* inclined relative to the perpendicular direction is constituted as an inclined surface.

Similarly to the second embodiment, the gas-liquid separating member 300 is welded by heat on the ceiling wall 315 from the air passage 314 side to close the opening 315*a* such that boundary line 310*a*, in the widthwise direction, between the water repellent porous member 310 and the blocking portion 311 is inside the large side of the opening 315*a*.

The other structure of the container of this embodiment is the same as that of the sub-container structure of the second embodiment.

Referring to FIGS. 8*a*-8*s c*, the description will be made as to the operation when the ink 321 (liquid) is supplied or filled into the sub-container 1.

When the ink is to be supplied into the ink absorbing material chamber 309 of the sub-container, the air passage 314 is connected with the pressure reduction pump. Therefore, the pressure of the air passage 314 is reduced, so that gas 320 in the ink absorbing material chamber 309 is discharged to the outside through the water repellent porous film 310 similarly to the first and second embodiments. Then, the ink 321 is supplied into the ink absorbing material chamber 309 through the supply tube connected with the main container. With the ink supply continuing, the liquid surface of the ink in the ink absorbing material chamber 309, that is, the gas-liquid interface 322 therein rises (FIG. 8*a*).

The gas 320 is sufficiently discharged from the ink absorbing material chamber 309, and then, with the continuing ink supply, the ink liquid surface (gas-liquid interface) rises in the opening 315*a* from the short side toward the large side, and the ink liquid surface, that is, the gas-liquid interface 322 further rises to contact the water repellent porous film 310 which is inclination.

With the further ink supply, the contact line 323 between the gas-liquid interface 322 and the water repellent porous film 310 reaches the boundary line 310*a* between the water repellent porous film 310 and the blocking portion 311, upon which the discharging of the gas 320 from the ink absorbing material chamber 309 stops. So, the ink supply stops with the ink absorbing material chamber 309 is filled with the ink 321 (FIG. 8*c*).

At the time of the stop of the ink supply, the air is trapped between the blocking portion 211 and the gas-liquid interface 322 in the ink absorbing material chamber 309, and the trapped air does not dissipate. Therefore, the impact resulting from the collision of the ink 221 to the water repellent porous film 310 can be avoided.

The operation per se of this embodiment is substantially the same as that of the first embodiment, the movement of the gas-liquid interface is stabilized.

Fourth Embodiment

Figure 9:
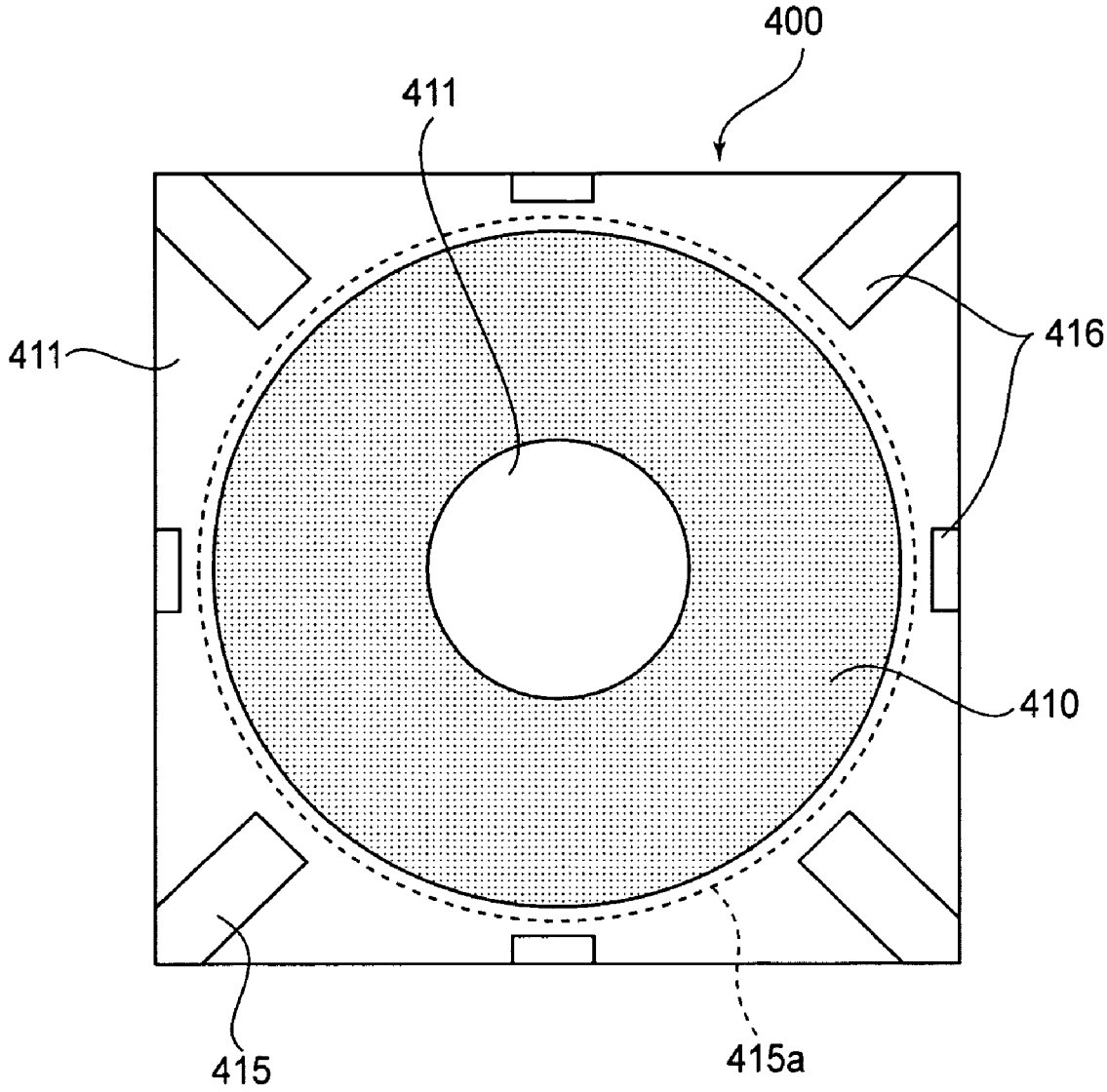
FIG. 9 is a schematic perspective view of a gas-liquid separating member according to a fourth embodiment of the present invention as seen from an air passage side.
Figure 10:
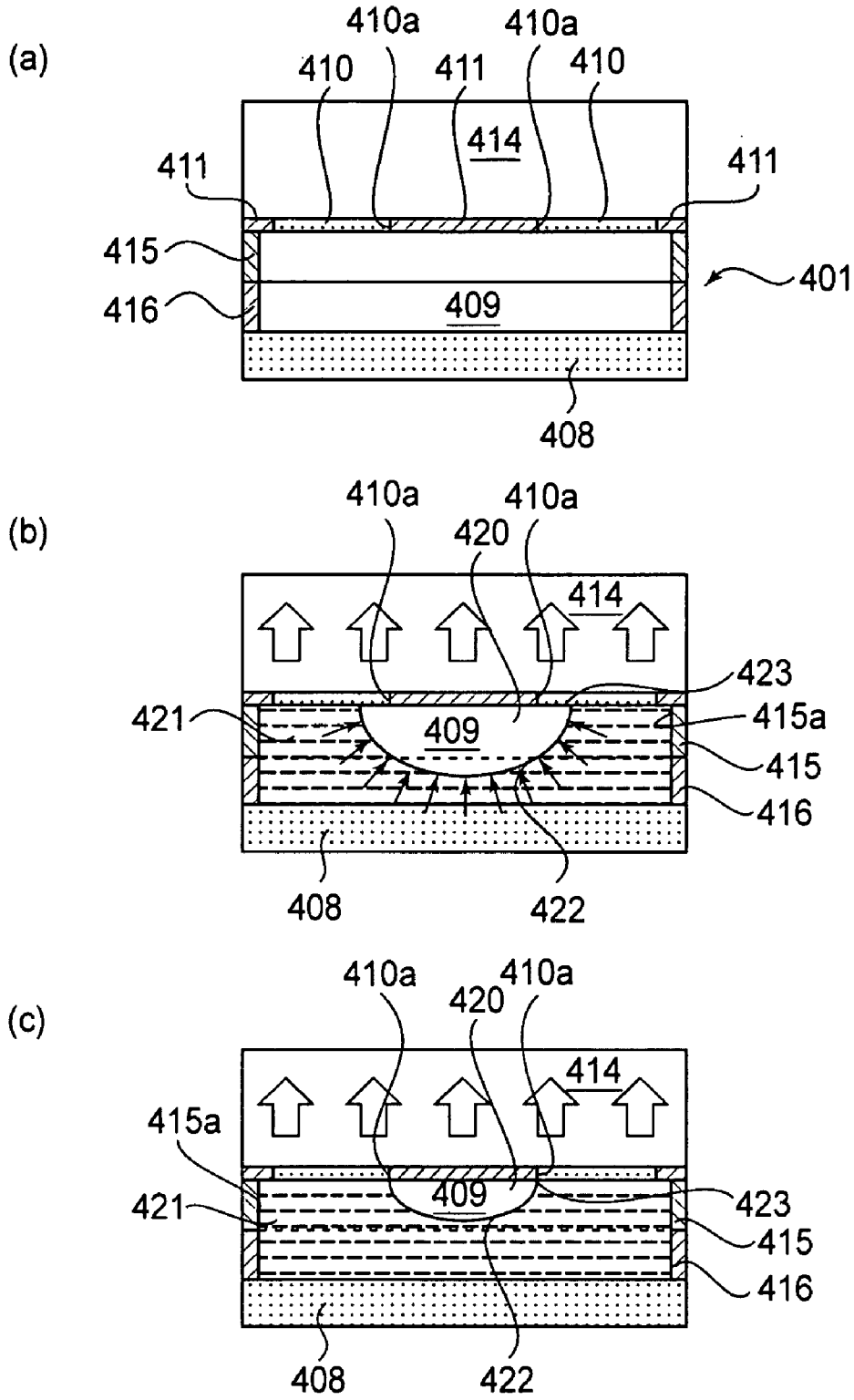
FIGS. 10(*a*)-10(*c*) are enlarged sectional views of a major part of the gas-liquid separating member of this embodiment to illustrate the operation during the ink supply and filling operation in this embodiment.

FIG. 9 shows a fourth embodiment of the present invention, and is a schematic perspective view of a gas-liquid separating member as seen from the air passage. FIGS. 10*a*-10*s c* are enlarged sectional views of a major part of the gas-liquid separating member of this embodiment to illustrate the operation during the ink supply and filling operation in this embodiment. FIG. 10*a* shows a state immediately before the ink liquid surface reaches the opening formed in the ceiling wall; FIG. 10*b* shows a state immediately after a part of the ink 513 reaches the water repellent porous film 510, and a bubble 520 is formed; and FIG. 10*c* shows a state in which the ink supply stops.

In FIGS. 9 and 10*a*, designated by 400 is a gas-liquid separating member in this embodiment; 410 is a water repellent porous film; 411 is a blocking portion; 415*a* is a circular opening formed in the ceiling wall 415; and 416 is an absorbing material holding member in the form of a rib. The other structures are substantially the same as in the first embodiment.

The gas-liquid separating member 400 in this embodiment, is a plate-like member (rectangular in this example) having an area completely covering the opening 415*a*, and the central portion is provided with a circle-like water repellent porous film 410. The configuration of the gas-liquid separating member may be similar to the outer shell configuration (circular) of the flat opening 415*a*. In this embodiment, the central portion of the circle-like water repellent porous film 410 is further provided with a circular blocking portion 411 which does not pass the gas or the liquid. The circular outer periphery surrounding the water repellent porous film 410 is also a blocking portion 411 which does not pass the gas or the liquid. The sizes of the water repellent porous film 410 and the blocking portion 411 at the central portion of the water repellent porous film 410 are not limited to this example.

The gas-liquid separating member 400 is welded by heat on the ceiling wall 415 from the air passage 414 side such that blocking portion 411 at the central portion of the water repellent porous member 410 is substantially concentrically disposed in the opening 415*a*, thus closing the opening 415*a*.

Referring to FIGS. 10*a*-10*s c*, the description will be made as to the operation when the ink y21 (liquid) is supplied or filled into the sub-container.

When the ink is to be supplied into the ink absorbing material chamber 409 of the sub-container, the air passage 414 is connected with the pressure reduction pump, and therefore, the pressure in the air passage 414 is reduced. Similarly to the first, second and third embodiments, the gas 420 in the ink absorbing material chamber 409 is discharged to the outside through the water repellent porous film 410. Then, the ink 421 is supplied into the ink absorbing material chamber 409 through the supply tube connected with the main container. With the ink supply continuing, the liquid surface of the ink 421 in the ink absorbing material chamber 409, that is, the gas-liquid interface 122 therein rises (FIG. 10*a*).

When the ink 421 is further supplied into the sub-container, the ink 421 reaches a part of the water repellent porous film 410, the remaining gas is formed into bubbles 420 on the porous film 410 due to the water repellent property of the water repellent porous film 410 (FIG. 10*b*).

With the continuing reduced pressure, the gas in the bubbles 420 passes through the water repellent porous film 410, and the bubble 420 gradually reduces in size. The discharging of the gas stops at the time when the contact line 423 between the gas-liquid interface 422 between the gas in the bubble 420 and the water repellent porous film 410 reaches the boundary between the water repellent porous film 410 and the blocking portion 411 provided at the central portion of the porous film 410. Therefore, the supply of the ink 421 into the sub-container stops (FIG. 10*c*).

Upon the stop of the ink supply, the gas is trapped in the form of bubbles 420 right below the blocking portion 411 provided at the central portion of the water repellent porous film 410 in the ink absorbing material chamber 409 more particularly in the opening 415*a*. However, the bubble 420 does not dissipate because the gas in the bubbles 420 are no longer discharged. Therefore, the impact resulting from the collision of the ink 221 to the water repellent porous film 210 can be avoided.

In this embodiment, the gas-liquid separating member 400 including the water repellent porous film 410 is also flat, and therefore, the mounting is easy. In addition, the movement of the contact line 423 between the water repellent porous film 410 and the gas-liquid interface is not in the vertical direction (height direction) but is horizontal direction relative to the water repellent porous film 410, and therefore, the required volume can be saved. Furthermore, the structure of the lower portion of the gas-liquid separating member 400 including the water repellent porous film 410 is simple, but the same advantageous effects as with the first, second and third embodiments can be provided.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 357303/2004 filed Dec. 9, 2004 which is hereby incorporated by reference.

What is claimed is:

1. A liquid container comprising:

a liquid containing portion for containing ink;

a liquid introduction portion for introducing liquid from an outside into an inside of said liquid containing portion;

a liquid discharge portion for discharging the liquid from the inside of said liquid containing portion to an outside of said liquid containing portion;

a gas-liquid separating member provided in an upper side, in use, of said liquid containing portion, said gas-liquid separating member including a gas-liquid separation film and a blocking portion in which said gas-liquid separation film is disposed, wherein said blocking portion does not pass gas or liquid, and wherein a space region is provided below said gas-liquid separating member;

wherein a pressure in said container is reduced through said gas-liquid separation film to discharge the gas from the inside of said liquid containing portion to the outside of said liquid containing portion so that liquid is introduced into said liquid containing portion through said liquid introduction portion, wherein said one or both of said gas-liquid separating member and said gas-liquid separation film has a portion which is inclined relative to a side of said liquid containing portion such that a contact line provided by contact between a gas-liquid interface between the introduced liquid and the gas and said gas-liquid separation film moves toward a boundary between said gas-liquid separation film and said blocking portion, and wherein introduction of the liquid is completed with a state in which the gas-liquid interface between the liquid and the gas reaches the boundary between said gas-liquid separation film and said blocking portion, and in the state in which gas is in a region which is below said blocking portion which takes an upper position in use.

2. A liquid container according to claim 1, wherein said gas-liquid separation film is substantially convex toward said liquid containing portion.

3. A liquid container comprising:

a liquid containing portion for containing ink;

a liquid introduction portion for introducing liquid from an outside into an inside of said liquid containing portion;

a liquid discharge portion for discharging the liquid from the inside of said liquid containing portion to an outside of said liquid containing portion;

a gas-liquid separating member provided in an upper side, in use, of said liquid containing portion, said gas-liquid separating member including a gas-liquid separation film and a blocking portion in which said gas-liquid separation film is disposed, wherein said blocking portion does not pass gas or liquid, and wherein a space region is provided below said gas-liquid separating member, wherein a pressure in said container is reduced through said gas-liquid separation film to discharge the gas from the inside of said liquid containing portion to the outside of said liquid containing portion so that liquid is introduced into said liquid containing portion through said liquid introduction portion, wherein a passage having a trapezoidal section in a liquid containing portion side of said gas-liquid separation film is provided, and wherein said gas-liquid separation film is disposed in a narrow side of said trapezoidal passage and said blocking portion is disposed in a wide side of said trapezoidal passage, such that a contact line provided by contact between a gas-liquid separation interface between the introduced liquid nd the gas and said gas-liquid film moves toward a boundary between said gas-liquid separation film and said blocking portion, wherein introduction of the liquid is completed with a state in which the gas-liquid interface between the liquid and the gas reaches the boundary between said gas-liquid separation film and said blocking portion, and in the state in which gas is in a region which is below said blocking portion which takes an upper position in use.

4. A liquid container comprising:

a liquid containing portion for containing ink;

a liquid introduction portion for introducing liquid from an outside into an inside of said liquid containing portion;

a liquid discharge portion for discharging the liquid from the inside of said liquid containing portion to an outside of said liquid containing portion;

a gas-liquid separating member provided in an upper side, in use, of said liquid containing portion, said gas-liquid separating member including a gas-liquid separation film and a blocking portion in which said gas-liquid separation film is disposed, wherein said blocking portion does not pass gas or liquid, and wherein a space region is provided below said gas-liquid separating member, wherein a pressure in said container is reduced through said gas-liquid separation film to discharge the gas from the inside of said liquid containing portion to the outside of said liquid containing portion so that liquid is introduced into said liquid containing portion through said liquid introduction portion, wherein said gas-liquid separation film has an annular form extending horizontally around said blocking portion such that a contact line provided by contact between a gas-liquid interface between the introduced liquid and the gas and said gas-liquid separation film moves toward a boundary between said gas-liquid separation film and said blocking portions, wherein introduction of the liquid is completed with a state in which the gas-liquid interface between the liquid and the gas reaches a boundary between said gas-liquid separation film and said blocking portion, and in the state in which gas is in a region which is below said blocking portion which takes an upper position in use.

* * * * *